US008233646B2

(12) United States Patent
Lutz et al.

(10) Patent No.: US 8,233,646 B2
(45) Date of Patent: Jul. 31, 2012

(54) ACOUSTIC DEVICE AND METHOD OF MANUFACTURING SAME

(75) Inventors: Josef Lutz, Rohrau (AT); Susanne Windischberger, Vienna (AT)

(73) Assignee: Knowles Electronics Asia PTE. Ltd., Singapore (SG)

( * ) Notice: Subject to any disclaimer, the term of this patent is extended or adjusted under 35 U.S.C. 154(b) by 732 days.

(21) Appl. No.: 12/303,770

(22) PCT Filed: May 16, 2007

(86) PCT No.: PCT/IB2007/051883

§ 371 (c)(1), (2), (4) Date: Dec. 8, 2008

(87) PCT Pub. No.: WO2007/141685

PCT Pub. Date: Dec. 13, 2007

(65) Prior Publication Data

US 2010/0239109 A1 Sep. 23, 2010

(30) Foreign Application Priority Data

Jun. 8, 2006 (EP) ..... 06115182.5

(51) Int. Cl.
*H04R 25/00* (2006.01)

(52) U.S. Cl. ..... 381/190; 381/150

(58) Field of Classification Search ..... 381/152, 381/190, 150, 423, 426

See application file for complete search history.

(56) References Cited

U.S. PATENT DOCUMENTS

| | | | | |
|---|---|---|---|---|
| 4,439,640 | A * | 3/1984 | Takaya | 381/190 |
| 7,382,890 | B2 * | 6/2008 | Saiki et al. | 381/152 |

FOREIGN PATENT DOCUMENTS

| | | | |
|---|---|---|---|
| DE | 2914608 | A1 | 10/1980 |
| DE | 4135408 | A1 | 4/1993 |
| EP | 0750443 | A2 | 12/1996 |
| JP | 64005199 | | 10/1989 |
| JP | 11165396 | | 6/1999 |

* cited by examiner

*Primary Examiner* — Walter L Lindsay, Jr.

(74) *Attorney, Agent, or Firm* — Steven McMahon Zeller; Dykema Gossett PLLC

(57) ABSTRACT

An acoustic device (500), comprising an oscillatory membrane (501) which comprises a transducing element (503) and a frame (504) adapted for accommodating the membrane (501) in an accommodation plane, wherein the membrane (501) is accommodated in the frame (504) in such a manner that a translational motion of the membrane (501) in at least one direction of the accommodation plane is made possible.

12 Claims, 3 Drawing Sheets

ACOUSTIC DEVICE AND METHOD OF MANUFACTURING SAME

FIELD OF THE INVENTION

The invention relates to an acoustic device.

Moreover, the invention relates to a method of manufacturing an acoustic device.

BACKGROUND OF THE INVENTION

Audio playback devices become more and more important. Such audio devices usually comprise loudspeakers and/or microphones.

JP 11164396 A discloses a piezoelectric loudspeaker provided by forming a vulcanized rubber at a state of thin film in some parts of a piezoelectric element of the piezoelectric loudspeaker. A metal vibration plate is stuck to the surface of a piezoelectric body of a titanic acid zirconic acid lead sintered body, forming a thin film on the surface by applying a diene rubber made into a heat cross-linked type by adding a sulfur component or a vulcanizable non-diene rubber material or their co-polymer and the thin film is used as the piezoelectric element of the piezoelectric loudspeaker. The heat cross-linked type rubber thin film is also formed on a foaming body. Thus, an edge is formed and a vibration plate-edge integrated type of member capable of supporting the vibration plate is obtained.

EP 0,750443 A discloses a piezoelectric acoustic device comprising a case and a piezoelectric element which is accommodated in the case and has an inner peripheral surface thereof supported by an inner peripheral surface of the case at a middle portion thereof. A plurality of projections are provided on an inner peripheral surface of the case and spaced circumferentially along the inner peripheral surface of the case for supporting the peripheral portion of the piezoelectric element. A gap between the peripheral portion of the piezoelectric element and the inner peripheral surface of the case is closed by an elastic adhesive. A plurality of projections provided on and spaced circumferentially along the inner peripheral surface of the case contact the periphery of the piezoelectric element at the tips thereof, which restricts a radial movement of the piezoelectric element relative to the case.

However, conventional piezoelectric acoustic devices suffer from insufficient performance.

OBJECT AND SUMMARY OF THE INVENTION

It is an object of the invention to provide an acoustic system with proper performance.

In order to achieve the object defined above, an acoustic device and a method of manufacturing same according to the independent claims are provided.

According to an exemplary embodiment of the invention, an acoustic device is provided comprising an oscillatory membrane which comprises a transducing element, and comprising a frame adapted for accommodating the membrane in an accommodation plane, wherein the membrane is accommodated in the frame in such a manner that a translational motion of the membrane (relative to the frame) in at least one direction of the accommodation plane is made possible.

According to yet another exemplary embodiment of the invention, a method of manufacturing an acoustic device is provided, wherein the method comprises accommodating an oscillatory membrane which comprises a transducing element in a frame in such a manner that a translational motion of the membrane (relative to the frame) in at least one direction of an accommodation plane is made possible.

The term "transducing element" may particularly denote an element which is functionally coupled to the membrane or forms part thereof, and which is adapted to convert acoustic waves into another kind of signals (for instance into electrical signals), or vice versa. Thus, a piezoelectric element is an example for a transducing element. Another example is a bi-metal element, which may be supplied with a thermal signal and which converts this thermal signal into an acoustic wave emitted by the membrane.

According to an exemplary embodiment of the invention, a piezoelectric speaker or microphone may be provided, in which a piezoelectric active membrane is flexibly received on/in a frame in a manner to allow a translational motion of at least a part (for instance of an edge part) of the membrane in a plane defined by the receiving section of the frame. By taking this measure, the audio detection and/or playback accuracy of the piezoelectric acoustic device may be significantly improved, since the mechanical flexibility and thus sensitivity of the membrane may be increased. Furthermore, properties related to the resonant frequency of the piezoelectric acoustic device may be significantly improved by changing the flexibility characteristics. By taking this measure, it may particularly be possible to implement a piezoelectric acoustic device according to an exemplary embodiment of the invention into portable devices (like mobile phones) with low effort.

Therefore, according to an exemplary embodiment, improvements of acoustic properties of a piezoelectric speaker may be made possible by designing appropriate boundary conditions. A piezoelectric speaker membrane or piezoelectric microphone membrane with a special kind of suspension may be provided. The suspension may comprise a soft foam ring in combination with, for instance, four rigid pillars. The foam ring may ensure an airtight sealing between an upper surface and a lower surface of the membrane while allowing the membrane to move relatively freely. The pillars inhibit or limit movement of the membrane in the z-direction, that is to say, in a direction perpendicular to a plane in which the membrane is received in the frame.

As an alternative to a pillar, any other local elevation in the receiving plane may be used to locally reduce the space in the z-direction, in which the soft foam element may be positioned (like a generally L-shaped elevated angle element in at least a part of corners of a rectangular receiving section, bumps, protrusions, etc.).

Therefore, it is possible to clamp, mount, or insert the membrane on the frame in such a manner that a membrane motion in the x-direction and/or in the y-direction (but, according to an exemplary embodiment, not in the z-direction) is made possible, optionally combined with the freedom to perform a rotation or inclination of the edge of the membrane about any desired axis.

For instance, the x-direction and the y-direction may be defined to be the directions spanning the accommodation plane, whereas the z-direction may be defined to be the direction perpendicular thereto.

The membrane may be fixed to the frame in such a manner that an edge of the membrane may move in the x-direction and/or in the y-direction. For instance, this may be achieved using a foam rubber clamping the membrane to the frame under a compression force in combination with a number of (for instance four) bumps or pins or protrusions extending from the frame and clamping particular portions of the membrane and/or compressible foam material to the frame. This configuration allows both, mechanical stability and function-related flexibility of the membrane, improving the acoustic playback or recording properties of the speaker or microphone membrane.

Conventional dynamic loudspeakers may be inappropriate for applications which, for instance, require mechanically very flat components or do not allow magnetic stray fields. In such cases, the implementation of piezoelectric acoustic transducers may be appropriate. These may be adapted as bending transducers (the transverse contraction of the piezoelectric material under mechanical stress or tension may bend a multilayer system of, for instance, a piezoelectric material and a membrane, or a piezoelectric material and another piezoelectric material) in an extremely flat manner (for instance significantly flatter than 1 mm) and do not require a magnetic field for their function.

However, a disadvantage of conventional piezoelectric acoustic transducers is their relatively poor adaptation to the acoustic requirements of an acoustic wave in air. One point in this respect is that the elongation (that is the motion of the transducer) caused by the small length alteration of the piezoelectric effect, is comparably small and thus the acoustic pressure (and therefore the audio amplitude) is relatively small. On the other hand, the base resonance of the transducer is relatively high due to the relatively high modulus of elasticity of the materials.

Due to these properties of conventional piezoelectric acoustic devices, the fields of application of such devices are restricted to large area applications or to applications with a limited acoustic performance with regard to frequency response and amplitude. Due to the large areas, the equivalent back volume is very large (this volume is usually proportional to the square of the area), and therefore an implementation in mobile devices (such as mobile phones) is difficult or practically impossible.

According to an exemplary embodiment of the invention, the properties of the boundary conditions of a piezoelectric transducer may be improved, so that, even for small areas of the transducer, a sufficiently large elongation is possible and the resonant frequency may be made sufficiently small for an application in the field of mobile devices (for instance for mobile phones).

Embodiments of the invention are based on the recognition, as could be shown by finite element method (FEM) simulations, that an essential reason for the relatively poor acoustic performance of conventional piezoelectric transducers is their fixed clamping in a rigid frame.

In the following, some considerations in this respect on which embodiments of the invention are based will be explained for a transducer with a circular area.

In accordance with the above-mentioned conventional way of fastening, all six degrees of freedom (three translational degrees of freedom and three rotational degrees of freedom) along an edge are fixed. Therefore, the edge of the transducer (membrane) and its environment can perform neither a translatory nor a rotational motion. A result of such a conventional concept is a high base frequency, a small amplitude range and a small effective area.

By allowing a rotational motion along an edge of the membrane, the base frequency, the amplitude range, and the effective area may be significantly improved. The effective area may become particularly large for a round transducer at the base frequency.

However, fixing the translatory degrees of freedom of the membrane turned out to be a remaining disturbing limitation.

The restriction of the position of the membrane edge in the z-direction may be highly advantageous, since, when the position in the z-direction is not defined or is defined only very poorly, the transducer oscillates around its own center of gravity, thereby reducing or minimizing the displaced air volume (which is the product of an effective area multiplied with an average elongation), thereby reducing or minimizing the acoustic or audio pressure.

In contrast to this, a limitation of the motion in the x-direction and/or in the y-direction turned out to have the consequence that the material has to be expanded or stretched in a motion outside the rest position (larger length). The large values of the modulus of elasticity of the materials used may result in a significant increase of the base frequency of the transducer, resulting in a correspondingly small amplitude. Therefore, a small base frequency and a large displaced air volume can be obtained when all degrees of freedom of the membrane edge motion—with the exception of the position in the z-direction—are free. Alternatively, it is possible that, at least in one point, the motion in the x-direction and/or in the y-direction and/or the rotation in the xy-plane are not given free. Practically this may be ensured by a necessary frame and a suitable mounting of the transducer.

Due to the symmetry of a circular disk, the fixation in the z-direction along the entire edge may be considered to be identical with the mechanically required fixation at least three points. However, with a shape deviating from a circular shape, the fixation of the entire edge may result in a deterioration of the three essential acoustic parameters mentioned above (base frequency, amplitude range and effective area) in the z-direction.

As an example, the situation of a rectangular shape of the transducer will be considered in the following.

When fixing the entire edge of a rectangular membrane in the z-direction, only the area inside an ellipse, which is determined by the length and the width of the rectangle, carries out a significant motion. The amplitude is essentially defined by the smaller dimension of the rectangle.

Fixing only some edge points, for instance four edge points, of the rectangle in the z-direction, also the rest of the edge can move in the z-direction, and the motion of the transducer may be compared essentially with a disk having a diameter that is defined by the diagonal of the rectangular transducer (see FIG. 4). Therefore, the effective area becomes significantly larger, and so does the elongation in the z-direction.

In a practical application, it may be important that the edge portions at which all degrees of freedom are released, are connected to the frame in a tight manner, since otherwise essential parts of the displaced air volume may be shifted from a front side to a back side (this may be denoted as an "acoustic short circuit").

The release of the rotational motion along the edge could also be carried out in transducers by connecting the oscillating portion of the transducer via spring elements with the frame. Slits which are required for this may be closed with the plastic foil of the layer system plastic foil—metal foil—piezo. Although the modulus of elasticity of the plastic foil is usually essentially smaller than that of metal, the release of the xy-direction may not be sufficiently ensured with such an embodiment, and the release of the z-direction along the edges of a rectangular transducer is practically impossible. Furthermore, such a layer construction and the definition of the springs within the metal foil are a complex system which requires a cost-intensive method of manufacturing.

A possible solution which may fulfill the theoretical and practical requirements is sealing the entire edge in the frame using a soft plastic element (foam). By taking this measure, it is not only possible to release the tilting motion modes but also the motion modes corresponding to a translational direction in the x-direction and/or y-direction. The limitation of the motion in the z-direction may be defined by the height of the soft plastic element (foam) in the z-direction. The definition of the z-position at particular points can then be achieved easily by providing cupola-shaped protrusions in the frame. Selectively at these cupola-shaped protrusion portions, the soft plastic may be compressed to such an extent that the z-position of the membrane is practically fixed or defined. The cupola shape may further guarantee the freedom of the tilting positions and those in the x-direction and y-direction at these points.

Exemplary embodiments of the invention may have the advantage that, as compared to conventional solutions, the amplitude of the motion (of a central part of the membrane) in the z-direction may be significantly improved. Furthermore, the effective area may be increased. The resonant frequency may be reduced. Furthermore, such an acoustic device may be implemented in mobile devices, such as mobile phones. Beyond this, a simple implementation of the required boundary conditions is possible. Therefore, an improved loudness and an improved resonant frequency due to stress within the membrane when excited may be made possible.

Exemplary fields of application of embodiments of the invention are piezoelectric speakers and piezoelectric microphones.

According to an exemplary embodiment of the invention, the membrane may be not fastened at the entire edge portion with the exception of a defined number of (for instance four) points at which the membrane is fixed to the frame. For instance, these four points may be the corners of a rectangular membrane. By taking this measure, from the six degrees of freedom of motion (three degrees of rotation and three degrees of translation), particularly five degrees may be released, and only a motion of the edges of the membrane in a direction perpendicular to a suspension plane may be suppressed. By fixing the system in this only direction, it may be avoided that the system moves around its center of gravity, which might deteriorate the acoustic functionality.

Embodiments of the invention may be implemented in any transducing acoustic device in which the membrane itself comprises the signaling or transducing element. Such a signaling or transducing element may be the mechanism which allows for the conversion between mechanical signals (acoustic waves) and electrical signals (representing audio content), or vice versa. For example, such a transducing acoustic device may be a piezoelectric device, or may be a device having a thermally moved membrane (for instance implementing a bi-metal element on the membrane being controlled by a "temperature" signal).

Both, the front side and the back side of the membrane may be separated from one another in an essentially airtight manner, in order to improve the acoustic transmission properties.

Next, further exemplary embodiments of the invention will be explained. In the following, further exemplary embodiments of the transducing acoustic device will be explained. However, these embodiments also apply for the method of manufacturing a transducing acoustic device.

The membrane may be accommodated in the frame in such a manner that a translational motion of the membrane in the entire accommodation plane (xy-plane) is made possible. Therefore, particular edge portions of the membrane may be moved in a translatory manner within an accommodation plane, that is to say, within a plane defined by the frame in which the membrane is received. By releasing this degree of freedom, the acoustic properties of the system may be significantly improved.

The membrane may be accommodated in the frame in such a manner that a translational motion of at least a part of an edge of the membrane in at least one direction of the accommodation plane is made possible. It is possible to define specific fixed portions or points along an edge of the membrane, in which the membrane is fixed to the frame in a stable manner. However, non-fixed portions of the edge of the membrane may still have significant flexibility so as to allow a high degree of motion in this plane. This may allow both a stable mounting and a flexible vibration of the membrane.

The membrane may be accommodated in the frame in such a manner that a translational motion of the membrane in a direction perpendicular to the accommodation plane is allowed. This measure offers the advantage that the joining of the membrane to the frame is somewhat "soft" and allows a better movement of the membrane in the entire accommodation plane (because unevenness of the membrane and/or the frame does not matter) and a better tilting movement of the edge of the membrane (because the edges need some space in the z-direction when tilted—note also that the bumps 508 in FIG. 6 do not touch the membrane 501). Anyway, a translational motion has to be limited so as to ensure a proper function of the transducer. By avoiding that the edge portions of the plane are substantially displaced in a direction perpendicular to the accommodation plane, a deterioration of the acoustic functionality due to a motion of the entire system with respect to a center of gravity may be securely avoided.

The membrane may be fixedly connected to the frame only in at least one defined sub-portion of an edge of the frame. For instance, when the membrane is circular, it may be fixed along the entire edge. However, in a rectangular, square or polygonal configuration, it may be more appropriate to fix the membrane only in the corner portions, or in a part of the corner portions.

The membrane may be accommodated in the frame to be sealed in an airtight manner. Such an airtight sealing may improve the acoustic properties of the system, since an acoustic short circuit may be securely avoided.

The transducing acoustic device may comprise a soft member, for instance made of a compressible plastic, particularly of annular shape, provided between the membrane and the frame. Thus, the soft member may be of a frame-like structure which is connected to both main surfaces of the membrane. The membrane may comprise a metallic layer and a piezoelectric layer, wherein the main surfaces of these layers maintain uncovered from the soft member, for instance a soft foam member. Therefore, this configuration may promote the airtight acoustic decoupling between the two sides of the membrane, may support the desired flexibility and may be combined with elements for reducing flexibility by fixing specific points of the membrane to the frame.

The frame may comprise at least one bump, particularly four bumps (for instance provided at the corner portions of a rectangular membrane), having an extension perpendicular to the accommodation plane and acting upon the soft member to limit motion of the membrane. By providing such bumps, specific areas of the membrane may be defined in which the soft member is compressed by a respective protrusion/bump so as to prevent motion of the soft member and/or membrane specifically at these positions. In particular, convex shapes (up to a spike) are preferred for said bumps because they are more suitable to allow a tilting movement of the edge of the membrane. When using such convex bumps, the membrane may be accommodated in the frame in such a manner that a translational motion of the membrane in a direction perpendicular to the accommodation plane is substantially limited or even inhibited. Nevertheless, the tilting movement of the edge of the membrane is made possible because of the convex shape of the bumps.

The transducing device may be adapted as a piezoelectric acoustic device. A piezoelectric acoustic device may be denoted as a device that is based upon the piezoelectric effect. For instance, the device may be adapted as a piezoelectric microphone. A piezoelectric microphone may use the phenomenon of piezoelectricity—the tendency of some materials to produce an electric voltage when subjected to mechanical pressure, or vice versa—to convert vibrations into an electric signal. However, the device may also be adapted as a piezoelectric loudspeaker based on the phenomenon of piezoelectricity.

The acoustic apparatus may be adapted as a portable device. Due to the advantageous acoustic properties and due to the flat shape of the acoustic system according to exemplary embodiments of the invention, the transducing acoustic device may be suitable for portable applications such as a mobile phone with a proper performance (for instance a sufficient loudness and appropriate frequency behavior).

The acoustic apparatus may be realized as at least one of the group consisting of an audio surround system, a mobile phone, a headset, a loudspeaker, a hearing aid, a handsfree system, a television device, a video recorder, a monitor, a gaming device, a laptop, an audio player, a DVD player, a CD player, a hard-disk-based media player, an internet radio device, a public entertainment device, an MP3 player, a hi-fi system, a vehicle entertainment device, a car entertainment device, a medical communication system, a body-worn device, a speech communication device, a home cinema system, and a music hall system.

However, although the system according to an embodiment of the invention primarily intends to improve the quality of sound or audio data detection/reproduction, it is also possible to apply the system for a combination of audio data and video data. For instance, an embodiment of the invention may be implemented in audiovisual applications like a portable video player in which a loudspeaker or a headset or an ear set is used.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

DESCRIPTION OF EMBODIMENTS

Figure 1:
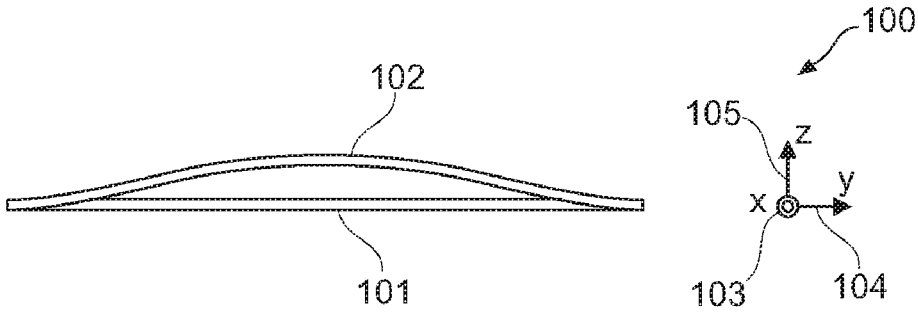
FIG. 1 to FIG. 4 show membrane vibration states of different piezoelectric acoustic devices.

The illustration in the drawing is schematic. In different drawings, similar or identical elements are provided with the same reference signs.

In the following, referring to FIG. 1 to FIG. 4, some basic recognitions and aspects, on which embodiments of the invention are based, will be explained before exemplary embodiments of the invention are described in detail.

Exemplary embodiments of the invention provide an improvement of acoustic properties of a piezoelectric speaker by designing appropriate boundary conditions. A corresponding method of fixing a membrane to a frame of a piezoelectric speaker will be explained.

FIG. 1 shows a membrane 100 in an idle position 101 and in an excited position 102. Such a membrane, which comprises a piezoelectric layer attached to a metal layer, is normally part of a planar piezoelectric speaker. An electric voltage applied to the piezoelectric layer causes the membrane 100 to bend, which in turn is used to produce sound. In conventional speaker designs, the edge of the membrane 100 is fixed to a framework in such a way that at said edge all six degrees of freedom (movement in the x-direction, y-direction, z-direction, rotation around x-axis, y-axis and z-axis) are fixed. Hence, the excitation of the membrane 100 is somewhat weak leading to a merely low acoustic performance, that is to say, low loudness and high resonance frequency. FIG. 1 also shows a coordinate system defining the x-axis 103, the y-axis 104 and the z-axis 105.

Figure 2:
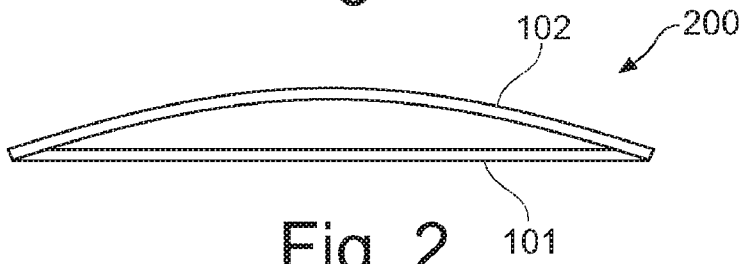

FIG. 2 shows a membrane 200, for which a rotation around the x-axis 103 is allowed. It will easily be appreciated that the volume, which is moved by the membrane 200 is higher than the one shown in FIG. 1. Consequently, the loudness of such a speaker is also higher. Furthermore, the resonance frequency is decreased.

Figure 3:
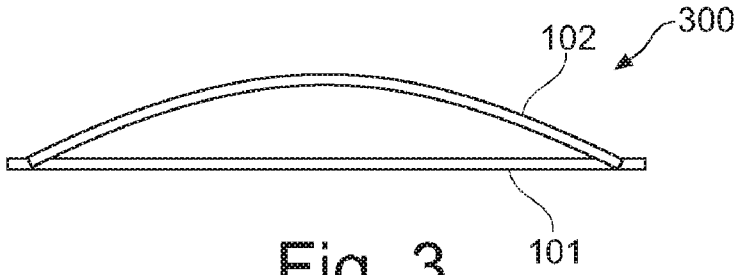

FIG. 3 shows a membrane 300, which is fixed according to an exemplary embodiment of the invention. The connection between the membrane 300 and a framework or housing of a piezoelectric speaker is of such kind that the edge of the membrane 300 may (additionally) move in the x-direction 103 and/or y-direction 104. This provides a further improvement of the loudness and the sound quality (that is to say, a lower resonance frequency). In a further improved embodiment, additionally the movement of some sections of the membrane 300 edge in the z-direction 105 is allowed.

Figure 4:
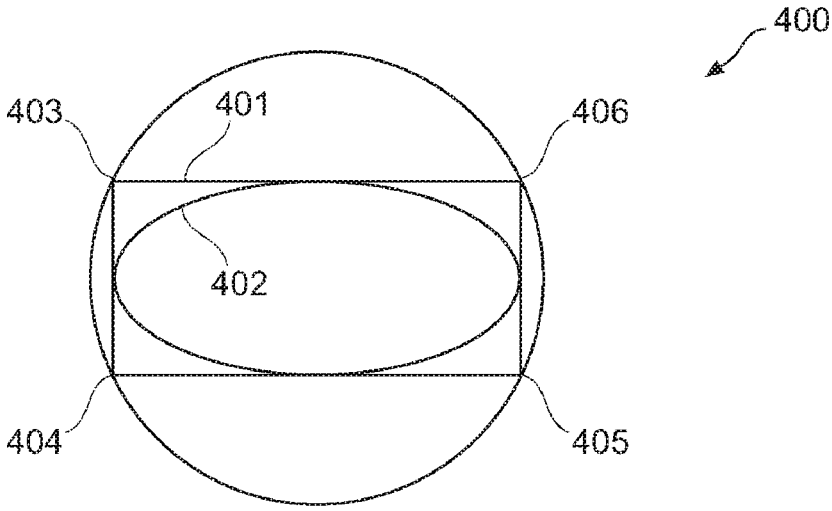

FIG. 4 shows a rectangular membrane 401 whose entire edge is fixed to a frame. That is why the active vibrating area of the membrane 401 may be described in a proper approximation by an ellipse 402. However, when only the edge portions 403, 404, 405 and 406 are fixed, the active oscillation area may be significantly increased.

Figure 5:
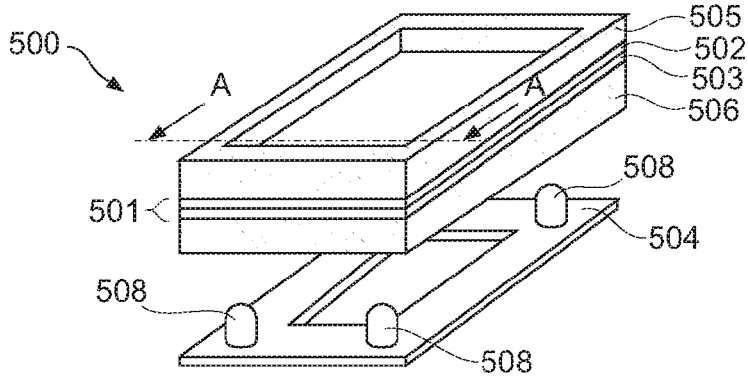
FIG. 5 shows a piezoelectric acoustic device according to an exemplary embodiment of the invention.

FIG. 5 shows a piezoelectric acoustic loudspeaker 500 according to an exemplary embodiment of the invention. The piezoelectric loudspeaker 500 comprises an oscillatory membrane 501 formed by a metal layer 502 and a piezoelectric transducing element 503. Furthermore, the piezoelectric speaker 500 comprises a frame 504 (only a part thereof shaped like a window is shown in FIG. 5), which is adapted for accommodating the membrane 501 in an accommodation plane xy, which essentially equals the upper surface of the frame 504.

Figure 6:
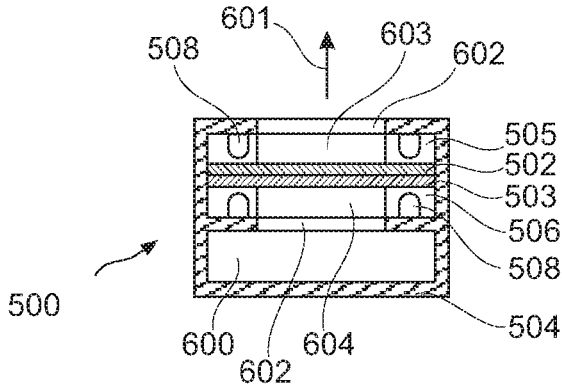
FIG. 6 shows a cross section of the piezoelectric acoustic device of FIG. 5 along an axis A-A in an assembled state.

As can be seen in FIG. 5 and in FIG. 6, which FIG. 6 shows a cross-section of the device 500 along an axis A-A, the membrane 501 is accommodated in the frame 504 in such a manner that a translational motion of the membrane 501 in the accommodation plane is made possible (x-direction and y-direction). However, because of the construction of the device 500, which will be explained in the following in detail, a translational motion of the membrane 501 in a direction perpendicular to the accommodation plane (z-direction) is essentially inhibited.

The acoustic device 500 comprises a first annular soft foam member 505 attached to an upper surface of the metal layer 502 and a second annular soft foam member 506 attached to a lower surface of the piezoelectric layer 503 of the membrane 501. The soft members 505, 506 are positioned between the membrane 501 and the frame 504, as shown in FIG. 5 and in detail in FIG. 6.

As can be seen in FIG. 5, the frame 504 comprises four bumps 508, one at each corner of the rectangular frame 504, which are formed as protrusions extending perpendicularly from the accommodation plane xy and acting upon the soft foam members 505, 506 in an assembled state of the system, as shown in FIG. 6, thereby limiting the motion of the membrane 501 in a direction perpendicular to the accommodation plane.

The four bumps 508 define the positions, at which the motion of the membrane 501 in relation to the frame 504 in the z-direction is inhibited or at least hindered, because when assembling the components of the device 500, the bumps 508 compress the soft material of the soft members 505, 506. Strictly speaking, the spring constant of the soft members 505, 506 is increased in the corners, so that a force acting on the membrane 501 causes a smaller movement in the corners than at another point of the membrane 501. Furthermore, the membrane 501 is accommodated in the frame 504 in an airtight manner, which is realized by the soft foam members 505, 506 as well.

FIG. 6 shows a cross-sectional view of the piezoelectric acoustic apparatus 500 along a cross-sectional area A-A and additional components of the framework 504. In the FIG. 6, the speaker 500 is shown in an assembled state, in which different components 504 of the framework (that is to say, of the speaker housing) are mounted. A back volume 600 is formed in a lower portion of the speaker 500, which back volume 600 is sealed to an exterior portion of the framework 504 (opposite to the sound emanating side 601) in an airtight manner. Furthermore, an aperture 602 of the framework 504 is shown, as well as apertures 603, 604 of the annularly shaped foam layers 505, 506. It should be noted that just one framework similar to the framework 504 may be used, so that bumps fix the membrane 501 just on one side. Furthermore, it should be noted, that the soft foam members 505, 506 may comprise recesses at positions corresponding to the position of the bumps 508 so as to fix the soft members 505, 506 in relation to the framework 504 by form fit and/or to allow a reduced compression of the soft members 505, 506 (compared to the compression that occurs in an arrangement as shown in FIGS. 5 and 6).

Figure 7:
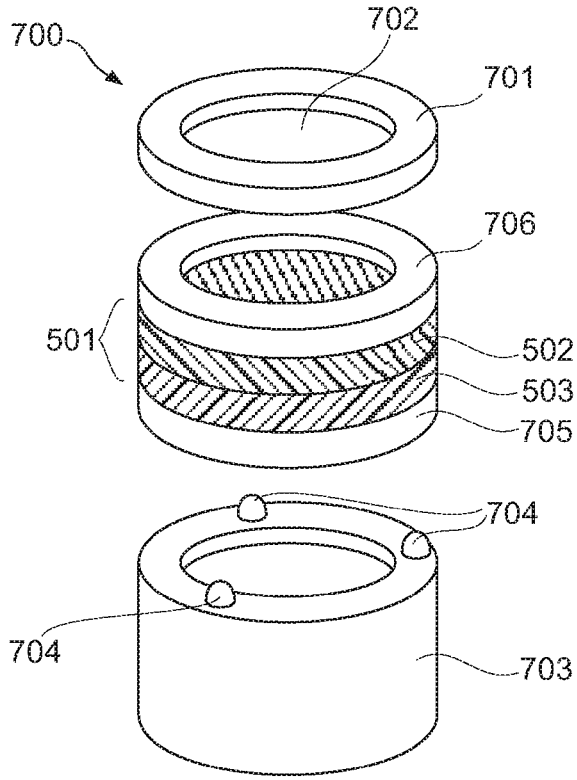
FIG. 7 shows a piezoelectric acoustic device according to an exemplary embodiment of the invention in a disassembled state.

FIG. 7 now shows a piezoelectric loudspeaker 700 according to an exemplary embodiment of the invention. A membrane 501 consisting of a metal layer 502 and a piezoelectric layer 503 (similar to the one shown in FIG. 5, but circular) is arranged between a lower annular soft foam element 705, which is attached to a lower surface of the membrane 501, and a second annular soft foam member 706, which is attached to an upper surface of the membrane 501. This arrangement is clamped between a ring-shaped upper framework part 701 (having a cylindrical through hole 702) and a ring-shaped lower framework part 703, which comprises protrusions or bumps 704. In the embodiment of FIG. 7, the lower framework part 703 comprises three protrusions 704, interspaced by essentially 120°.

Figure 8:
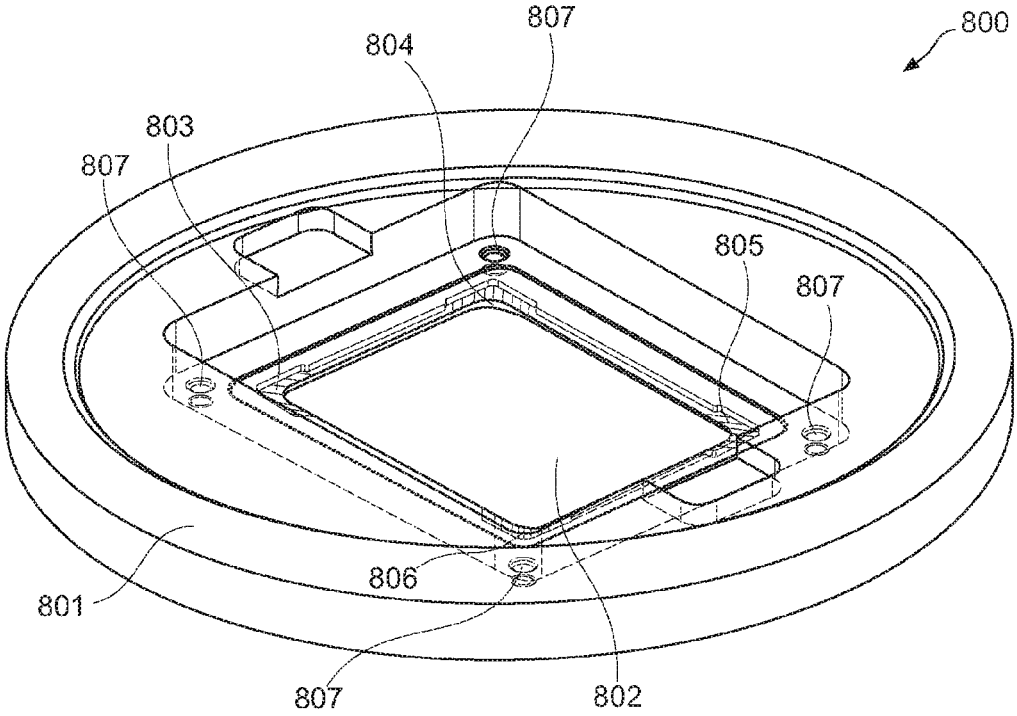
FIG. 8 shows a portion of a piezoelectric acoustic device according to an exemplary embodiment of the invention.

FIG. 8 shows a socket part 801 of a piezoelectric acoustic device 800 for accommodating a piezoelectric membrane (not shown in FIG. 8) according to a further exemplary embodiment of the invention. Such a membrane is accommodated in a central portion 802, which has an essentially rectangular shape. As can further be seen in FIG. 8, four edge portions 803, 804, 805, 806 are formed as essentially L-shaped protrusions or angle elements, which are provided at a slightly higher level than surrounding material. When a cover portion (which fits into the recess of the socket part 801) is attached to the socket part 801, the four corner portions 803 to 806 fix the piezoelectric membrane (with the rectangular annular soft form elements like the elements 505, 506) in the central portion 802 of the socket part 801. Furthermore, screw holes 807 are shown in the socket 800.

Figure 9:
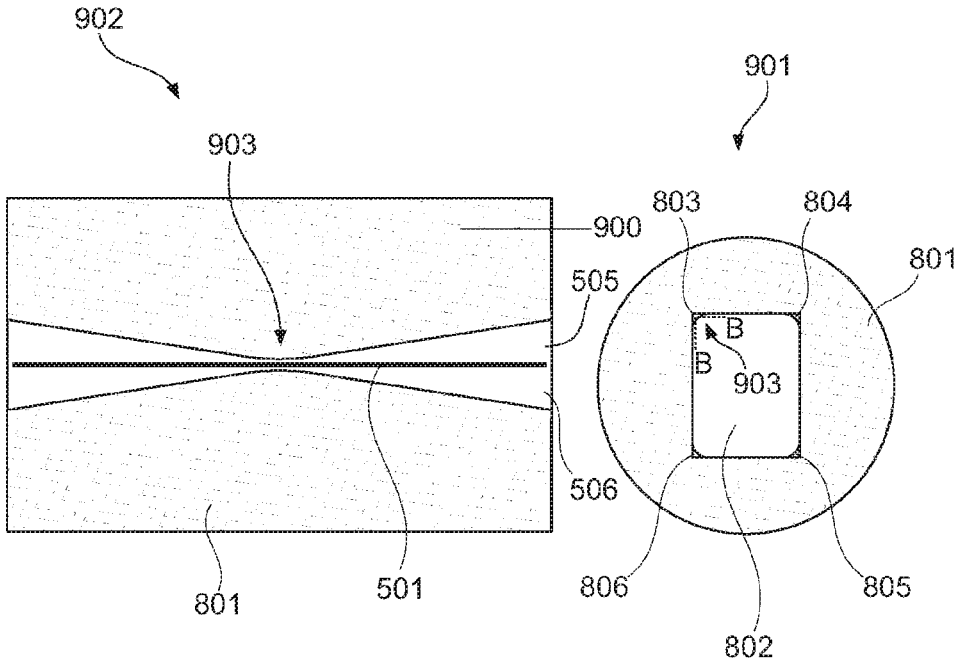
FIG. 9 shows a detailed view of a corner portion of the piezoelectric acoustic device of FIG. 8.

FIG. 9 finally shows in detail the corner portion 803 as a raised or elevated corner portion. When designing the edges 803 to 806, care should be taken to ensure that only one degree of freedom is locked, whereas the remaining degrees of freedom are released.

FIG. 9 shows a schematic plan view 901 of the socket part 801. Furthermore, FIG. 9 shows a cross-sectional view 902 along an angled line B-B of the plan view 901, with a cover part 900 assembled with the socket part 801 having the membrane 501 sandwiched in-between.

It can be seen that a central region 903 of the corner portion 803 is tapered as compared to an environment, so that the cover part 900 and the socket part 801 are located closer together in the central region 903 than in regions further apart from the central region 903. In this central region 903, the soft foam members 505, 506 are compressed due to the tapering profiles of the socket part 801 and of the cover part 900 (or holder part). Therefore, the speaker membrane 501 is fixed selectively in the corner 803, whereas adjacent portions of the speaker membrane 501 are relatively flexible.

Finally, it should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. The words "comprising" and "comprises", and the like, do not exclude the presence of elements or steps other than those listed in any claim or the specification as a whole. The singular reference of an element does not exclude the plural reference of such elements and vice versa. In a device claim enumerating several means, several of these means may be embodied by one and the same item of software or hardware. The mere fact that certain measures are recited in mutually different dependent claims does not indicate that a combination of these measures cannot be used to advantage.

The invention claimed is:

1. An acoustic device, comprising:

an oscillatory membrane comprising a transducing element;

a frame adapted for accommodating the membrane in an accommodation plane; and at least one soft member provided between the membrane and the frame;

wherein the membrane is accommodated in the frame in such a manner that a translational motion of the membrane in at least one direction of the accommodation plane is made possible;

and wherein the frame comprises at least one protrusion extending perpendicularly to the accommodation plane and acting upon the at least one soft member to limit motion of the membrane.

2. The acoustic device according to claim 1, wherein the membrane is accommodated in the frame in such a manner that a translational motion of the membrane in the entire accommodation plane is made possible.

3. The acoustic device according to claim 1, wherein the membrane is accommodated in the frame in such a manner that a translational motion of at least a part of an edge of the membrane in at least one direction of the accommodation plane is made possible.

4. The acoustic device according to claim 1, wherein the membrane is accommodated in the frame in such a manner that a translational motion of the membrane in a direction perpendicular to the accommodation plane is allowed.

5. The acoustic device according to claim 1, wherein the membrane is fixedly connected to the frame only in at least one defined sub-portion of an edge of the membrane.

6. The acoustic device according to claim 1, wherein the membrane is accommodated in the frame to be sealed in an airtight manner.

7. The acoustic device according to claim 1, wherein the at least one soft member is of an annular shape.

8. The acoustic device according to claim 1, wherein the frame comprises four protrusions extending perpendicularly to the accommodation plane and acting upon the at least one soft member to limit motion of the membrane.

9. The acoustic device according to claim 1, adapted as a piezoelectric acoustic device, particularly as one of the group consisting of a piezoelectric microphone and a piezoelectric loudspeaker.

10. The acoustic device according to claim 1, adapted as a portable apparatus.

11. The acoustic device according to claim 1, realized as at least one of the group consisting of: an audio surround system, a mobile phone, a headset, a loudspeaker, a hearing aid, a handsfree system, a television device, a video recorder, a monitor, a gaming device, a laptop, an audio player, a DVD player, a CD player, a harddisk-based media player, an internet radio device, a public entertainment device, an MP3 player, a hi-fi system, a vehicle entertainment device, a car entertainment device, a medical communication system, a body-worn device, a speech communication device, a home cinema system, and a music hall system.

12. A method of manufacturing an acoustic device, wherein the method comprises the steps of:

accommodating an oscillatory membrane which comprises a transducing element in a frame in such a manner that a translational motion of the membrane in at least one direction of an accommodation plane is made possible, providing at least one soft member between the membrane and the frame, and providing at least one protrusion of the frame extending perpendicularly to the accommodation plane and acting upon the at least one soft member to limit motion of the membrane.

* * * * *